US005673625A

United States Patent [19]

Dahlstrom

[11] Patent Number: 5,673,625

[45] Date of Patent: Oct. 7, 1997

[54] METHOD OF YARDING LOGS BY INTRODUCING SLACK INTO A MONO-CABLE SYSTEM

[76] Inventor: Gale Edward Dahlstrom, 2630 Bay Ave., Hoquiam, Wash. 98550

[21] Appl. No.: 452,039

[22] Filed: May 26, 1995

[51] Int. Cl.[6] ..... B61B 7/00

[52] U.S. Cl. ..... 104/173.1; 104/117; 104/178; 104/180

[58] Field of Search ..... 104/173.1, 173.2, 104/180, 183, 117, 178, 196

[56] References Cited

U.S. PATENT DOCUMENTS

| | | | |
|---|---|---|---|
| 1,556,819 | 10/1925 | Hires | 104/173.1 |
| 2,608,935 | 9/1952 | Moore et al. | 104/173.2 |
| 2,652,157 | 9/1953 | Wyssen | 104/173.1 |
| 3,012,518 | 12/1961 | Sawyer et al. | 104/173.1 |
| 4,023,502 | 5/1977 | Elsing | 104/173.2 |
| 4,523,525 | 6/1985 | Foster | 104/173.2 |
| 4,782,761 | 11/1988 | Asberg | 104/173.1 |
| 4,920,892 | 5/1990 | Pesek | 104/173.2 |

FOREIGN PATENT DOCUMENTS

| | | | |
|---|---|---|---|
| 1291470 | 2/1987 | U.S.S.R. | 104/173.1 |

*Primary Examiner*—Mark T. Le

*Attorney, Agent, or Firm*—Christensen O'Connor Johnson & Kindness PLLC

[57] ABSTRACT

A method and apparatus for yarding logs by introducing slack is provided for use with a mono-cable system having a continuous loop of cable strung through a logging area along a path that the harvested timber is conveyed. The invention includes advancing the mono-cable system along the path of the mono-cable system until a length of cable not being used to secure a log is available. Slack is then created in the cable of the mono-cable system, after which the cable is transported to a log located on either side and distant from the path. The choker is then secured to the log, and the hook of the choker is secured to the cable. The slack of the cable is then eliminated, such that the secured log is retrieved from its felled position distant from the path to a position adjacent the path. The cable is then advanced such that the hook of the choker is caught on a stopper of the mono-cable system, and the log is moved along the path to a transport location from which the log is removed from the logging area. The use of slack in the mono-cable system provides superior selective harvesting of trees at a logging site, reduces the labor required for retrieving such logs, increases the capacity of the mono-cable system, and reduces dangers heretofore inherent in conventional mono-cable systems caused by the height and constant tension required in the cable, while retaining the advantages of mono-cable systems over conventional line systems.

7 Claims, 7 Drawing Sheets

10
12
14
16
18
20
22
24
32
34
36a
36b
38
40
42
44
90a
90b

METHOD OF YARDING LOGS BY INTRODUCING SLACK INTO A MONO-CABLE SYSTEM

FIELD OF THE INVENTION

The present invention relates to a method and apparatus for yarding logs by introducing slack into a mono-cable system extending through an area from which selected logs are to be removed.

BACKGROUND OF THE INVENTION

Current logging practices are undergoing significant changes due to the increased opposition to clear cutting as a means for harvesting timber. In traditional clear cutting, where a clear path is cut through a stand of trees in order to remove the fallen trees, conventional yarding equipment has been used to retrieve the logs from between stumps and remaining trees to a location where they are loaded onto trailers for subsequent transport away from the logging area. One way to harvest timber without clear cutting of this nature is to remove selected trees from a given area while leaving many existing trees standing. This selective harvesting of timber is often referred to as thinning.

Conventional line systems have been created to further implement this selective harvesting or thinning. In such conventional line systems, a straight path is cleared through the trees between a logging road or other transport location from which logs can be removed from the logging area and a point distant from the logging road. A primary tower is set up at the logging road, and a corresponding secondary tower or sheave is positioned at the distant end of the cleared path. A line and carriage system is then secured between the two towers such that the carriage is typically suspended 15–20 feet above the ground along the cleared path. The line and carriage system has two lines, a movement line for movement of the carriage between the two towers and a retrieval line for extension and retraction of the carriage from its suspended position high above the ground to a position close to the ground, as well as a carriage to which a log or logs are secured. The carriage is first advanced along the movement line away from the primary tower to a point along the cleared path near felled trees or logs to be retrieved, where it is lowered as the retrieval line is extended to a position close to the ground using the retrieval line and allowed to swing in a pendulum-like fashion to the position of the logs on either side of the path. Logs are then secured to the carriage and raised to the movement line as the retrieval line retracts the carriage. The carriage and corresponding logs are then ferried back toward the primary tower, where the logs are subsequently lowered to the ground, released from the carriage, and loaded onto transport trailers.

While conventional line systems have distinct advantages over traditional yarding equipment as a means of selectively harvesting timber, such systems retain significant disadvantages. Initially, such conventional line systems are limited by their reliance on a straight, dear-cut path between their towers. In other words, to use a conventional line system, a straight, dear-cut path must be made through the trees. This requirement in itself is burdensome because it is difficult to lay out and clear a straight path through a stand of trees, due primarily to the existence of stumps and sighting obstructions along the path. Furthermore, while less injurious to the logging area than traditional clear cutting techniques, this requirement nevertheless works to defeat the theory behind selective harvesting since the logging area is left with straight, clear-cut paths.

In addition, the system's reliance on a cleared path along which the movement line and carriage transports the logs to the logging road, the "selectivity" of the harvesting is limited. Since the carriage is only capable of retrieving logs located to either side of the clear-cut path, and given that the carriage must be retracted and advanced toward the primary tower to retrieve the logs, there are only certain logs that can be retrieved from between existing trees due to obstruction caused by the position of stumps and remaining trees. This, in turn, limits the trees that can be thinned, and leads to uneven selective harvesting of the logging area.

Conventional line systems are also often limited by the geography of the land making up the logging area. Due to their reliance on a straight, clear-cut path and a line and carriage system suspended uniformly above the ground between two towers, conventional line systems cannot easily be implemented over hilly or mountainous terrain. Not only does the uneven terrain interfere with the straight path of the line and carriage system, but also with the movement of logs secured to the carriage along the path.

Flat or even terrain, conversely, may also limit the application of conventional line systems. Many conventional line systems are gravity driven, meaning that they are set up with the primary tower located uphill on higher ground than the secondary tower. Such systems rely on the deflection of the line from the primary tower to the secondary tower for the movement of the carriage down the slope to the log retrieval location. Thus, to implement conventional line systems in flat logging areas, power must be added so as to drive the carriage of the line and carriage system in both directions.

Yet another inherent disadvantage of conventional line systems is their inability to function over great distances. Conventional line systems are limited in their effective range depending upon the strength of the tower structures, the strength of the movement line and carriage assembly, as well as on the size of logs to be retrieved. In other words, there is a practical trade-off between the number of logs that can be transported by conventional line systems and the distance over which such logs can be transported. As a result, conventional line systems operate only over a relatively short distance, generally between 800 to 1,000 feet. This fact necessitates frequent dismantling and moving of conventional line systems to new straight, clear-cut path locations for subsequent system operation.

In order to meet demands of better thinning and selective harvesting of timber, logging equipment has been developed that allows fallen trees to be removed by a more circuitous route through the trees that remain standing than by use of the straight, clear-cut path retrieval used by conventional line systems. Such logging equipment can transport harvested trees along a meandering path to a location where they are loaded on trailers for subsequent transport from the logging area. One such system for thinning trees is known as a mono-cable system. The mono-cable system relies on a continuous loop of cable that is strung through a logging area along the path that the harvested timber is conveyed. The cable is generally fixed in length and driven by a mechanical means such as a hydraulic motor. Conventional choking equipment, including chokers, hooks, and stoppers, are used in conjunction with the cable to secure felled trees to the cable. Logging blocks having radially extending teeth are secured to standing trees or stumps, and are used to support and guide the cable along the path, as well as to change its direction through the logging area.

In one existing mono-cable system, the cable is provided with a plurality of annular sleeves secured along the length of the cable at intermittent locations. These sleeves act as the stoppers for the hooks that hang freely on the cable from one end and have at their opposite end a choker for securing a log or logs. In operation, the choker can be slid along the cable to a felled log and, if necessary, the cable itself can be advanced to assist in positioning the choker with respect to a log. Once the log is secured, the mono-cable system is advanced, causing the cable to slide through the hook until a stopper is reached, whereupon the stopper engages the hook and advances it along with the cable. The cable, stopper, hook, choker and secured log or logs are then transported along the meandering mono-cable system path to the point where they are conveniently loaded onto trailers.

Such mono-cable systems provide distinct advantages over conventional line systems. Mono-cable systems eliminate the need for clear cutting a straight path for placement of the towers and line and carriage assembly of conventional line systems. By eliminating the need for a straight, clear-cut path, mono-cable systems further preserve existing tree growth. Because the mono-cable system operates in a meandering, circuitous route through the existing tree growth, it provides for superior selective harvesting.

In addition, such mono-cable systems are not limited as to the distance they can operate through the logging area. While a conventional line system is limited based on the strength of its towers, line, and carriage assembly, as well as constrained by the number and weight of logs to be transported, the mono-cable system is limited only by the frequency of its logging block positions along the path of its cable. Since the mono-cable system is supported by these logging blocks positioned along existing trees or stumps throughout its route, there is theoretically no limit to the length of the route used in a mono-cable system. To support and transport larger or more numerous logs, the cable can be supported by logging blocks at more frequent locations along its path. For smaller logs, or if a stronger cable is selected, fewer logging blocks as supports are needed along the mono-cable system path. Regardless, the advantages of the mono-cable system over existing conventional line systems are readily apparent.

Despite the advantages of existing mono-cable systems over conventional line systems, such mono-cable systems still exhibit significant disadvantages that have heretofore discouraged their acceptance and use by the relevant logging industry. Using existing mono-cable systems, it is necessary to physically move an end of each log to a position adjacent the cable and then to physically lift that end of the log up to the cable to hook the choker on the end of the log or the hook of a choker already on a log to the cable. This is currently done while the cable is moving, so that the motion of the cable can retrieve the log from a position between existing trees or growth in the logging area along the direction of the moving cable. When the log has been advanced to the transport location, or location in which it is to be loaded on trailers, it is necessary to physically remove the hook holding the choker and the corresponding log from the moving cable and drop the log to the ground. When using the current mono-cable system, logs must be physically moved to and away from the cable; accordingly, the current system either works only with smaller logs, or requires greater manpower.

This process of yarding logs using a mono-cable system is not only physically difficult, but also dangerous. Due in part to the requirement that the cable be moving to retrieve logs to the mono-cable system path, and because the cable in existing systems is required to have continuous tension to maintain the movement of the cable, hooking logs to the cable and removing logs from the cable is a dangerous process. As the logs are hooked to the moving cable, there is an increased risk of catching a workers finger or arm in the hook or choker. Given that the log immediately begins to slide from its felled position toward the line and along the path as soon as the hook is in place, there is also a significant chance of catching the worker with either the choker or the moving log. In addition, when the secured log is to be removed from the line at the transport location, the hook must be disengaged from the moving line. The weight of the attached log strains the tension of the cable such that when the hook is disengaged from the cable, the cable has a tendency to quickly snap back to full tension, increasing the danger of injuring nearby workers.

By virtue of the fact that a log end must be physically lifted up to reach the cable, the mono-cable system cable must be low to the ground. This increases the chances that the hook securing the log will jump off the cable as it is carried through the logging block. In addition, placement of the cable low to the ground increases the likelihood that a portion of the cable burdened with logs will sag between the logging blocks so as to drag against the ground. This, in turn, increases the chances that the cable, choker, and/or log will catch on ground obstructions and impede the advancement of the mono-cable system.

When tension on the cable is increased by activating the hydraulic motor, the logging blocks which have been secured to a stump or a standing tree are extended horizontally such that the logging blocks are parallel with the ground. During normal operation, the cable rides in the grooves of each logging block. As a portion of the cable carrying the hook and stopper enters the logging block and begins to pass through, the vertically oriented hook either seats itself between the protruding teeth of the logging block or contacts a tooth along its side or at its end. When the hook is centered between the adjacent teeth, the hook assembly generally passes smoothly through the block. However, if the hook contacts a tooth at a location other than the trough between adjacent teeth, there is a tendency to pull the cable out of the trough and off the sheath, which increases the risk that the cable will jump the block. Because of the high tension of existing mono-cable systems, the potential injury to workers hooking the logs to the cable, or other logging person on the area, is high if the cable jumps the block. Additionally, the down time involved in restringing the cable onto a jumped block adds to the overall cost of the logging operation.

The potential for the hook assembly to jump off the logging block is further increased as the angle between the cable and the choker decreases, since it is more likely that the choker will get drawn into the logging block as part of the cable, causing it either to lock up or jump the block. Generally, the angle between the cable and the choker decreases the lower the cable of the mono-cable system is to the ground. Accordingly, it would be preferable to have a system where the cable is higher above the ground, so that the hook and choker lie more perpendicular to the cable as they are pulled along the path of the mono-cable system. This would result in fewer disadvantages associating with having the hooks or chokers lock up or jump the block.

An additional disadvantage inherent in both conventional line systems and existing mono-cable systems is their inability to pull secured logs from between awkward angles of existing trees or underbrush to the cable path for subsequent transport along the line. Because each existing system relies on advancement of the cable in a specific direction to retrieve the logs, the logs must be felled and/or moved so as to reduce awkward angles caused by the position of stumps and remaining trees. This, in turn, further limits the "selectivity" of the harvesting.

Although a system of yarding logs using a mono-cable system is currently in use, there is a need for a method and apparatus for yarding logs that retains the advantages of the mono-cable system over conventional mono-cable systems while further reducing the disadvantages and dangers associated with mono-cable systems, so as to make them acceptable and used by the logging industry.

SUMMARY OF THE INVENTION

The present invention relates to a method and apparatus for yarding logs that introduces slack into a mono-cable system. Specifically, the present invention relates to a method and apparatus for yarding logs for use with the mono-cable system having a continuous loop of cable strung, using free-wheeling logging blocks, through a logging area along a path that the harvested timber is conveyed. The method and apparatus also employs choking equipment used to secure felled trees or logs to the cable, including chokers, hooks connected to one end of each choker, and stoppers along the length of the cable at intermittent locations, and includes the step of introducing slack so as to transport the cable to the log. The method and apparatus advances the mono-cable system along the mono-cable system path until a length of cable not being used to secure a log is available. Slack is then created in the cable of the mono-cable system. Once the cable has slack, the cable is transported to a log located on either side and distant from the path of the mono-cable system or, in other words, to a log located where one of its ends cannot be manually positioned so as to be lifted and secured to the cable via the choker and hook. The choker is then secured to the log, and the hook of the choker is secured to the cable. The slack of the cable is then eliminated, such that the secured log is retrieved from its felled position distant from the path of the mono-cable system to a position adjacent the path. The cable is then advanced such that the hook of the choker is caught on a stopper of the mono-cable system, and the log is moved along the path to a transport location where the log can conveniently be transported away from the logging area.

In accordance with further aspects of this invention, the secured log is removed from its secured position along the cable to the transport location where the log can conveniently transported away from the logging area by advancing the mono-cable system having the secured log using the drive system to the transport location. Slack is then created in the cable of the mono-cable system. Once the cable has slack, the hook of the choker is removed from the cable, and the choker is removed from the log. The slack of the cable is then eliminated.

As will be appreciated from the foregoing summary, the invention provides a method and apparatus for yarding logs by introducing slack into a mono-cable system. Specifically, the present invention reduces the physical labor, limitations, and dangers associated with moving felled trees to a position adjacent the mono-cable system and lifting one end of the log to secure it to the moving cable. The present invention also reduces the cost and danger associated with suspending the cable near to the ground. Finally, the present invention overcomes disadvantages present in existing systems limiting their ability to "selectively" harvest timber by associating the retrieval process toward the mono-cable system path with the elimination of slack, as opposed to the advancement of the cable. By so doing, logs may be pulled from between existing trees or underbrush at a greater variety of angles with respect to existing cable systems, which, in turn, allows greater selectivity in harvesting trees over a larger area, and thereby enhances the preservation of the existing tree growth. By introducing slack into a mono-cable system, the invention provides these and other advantages over both conventional line and mono-cable systems while reducing the dangers associated therewith.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
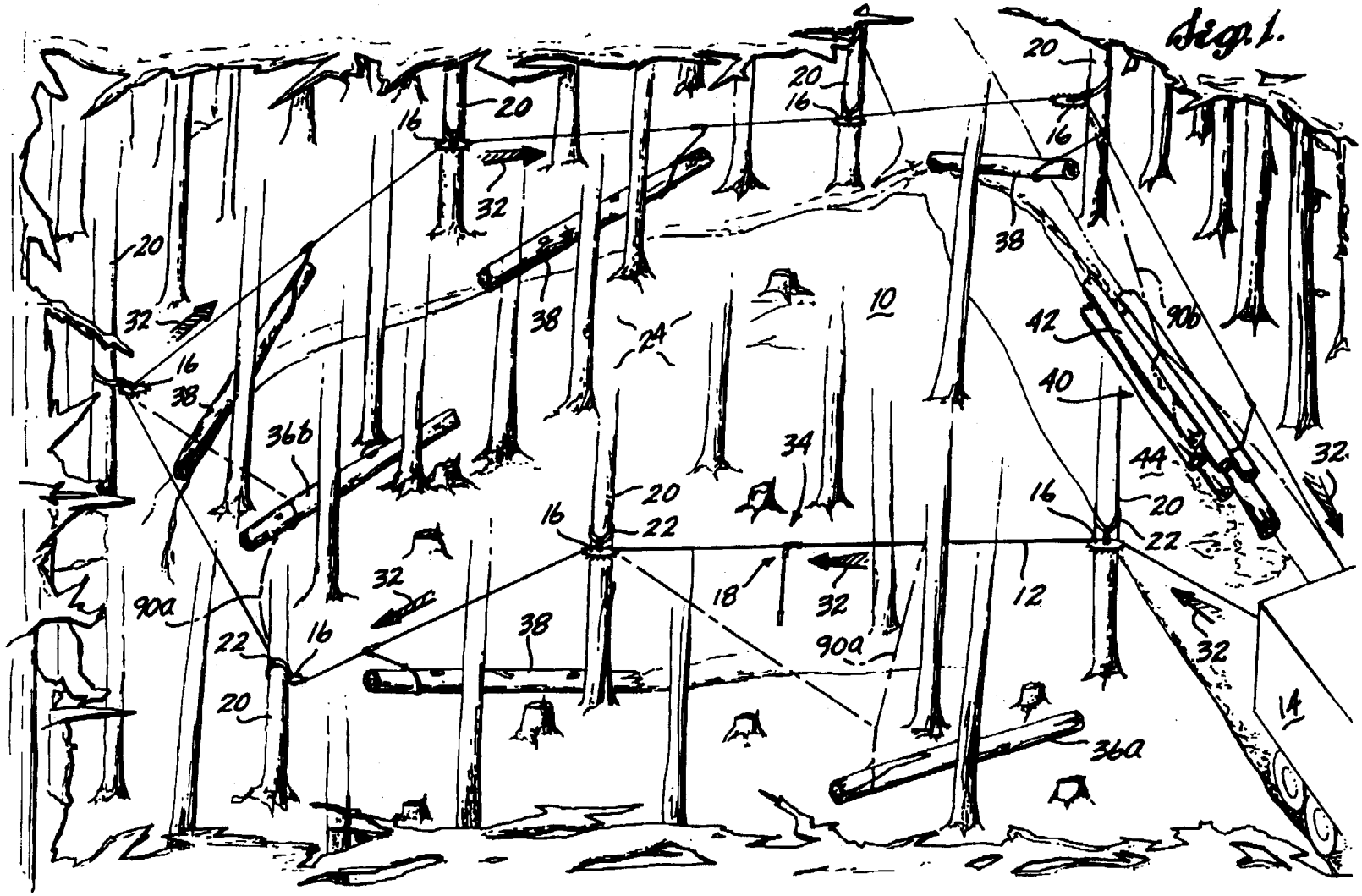
FIG. 1 is an environmental view of a mono-cable system having a continuous loop of cable strung through a logging area along a path that the harvested timber is conveyed and a power system, wherein slack is introduced to facilitate yarding logs.

Referring to FIG. 1, a mono-cable system 10 used to carry out the present invention includes a cable 12, a power system 14, logging blocks 16 through which the cable 12 passes, and log-securing assemblies 18. In the illustrated embodiment, the cable 12 is generally a cable manufactured from a high tensile strength material, such as steel, which is strung through an area to be logged, thereby defining the path of the mono-cable system through a stand of trees.

The cable 12 is guided through the logging area by the logging blocks 16, which in turn are attached to mounting trees 20, that are either trees not to be removed or stumps, by use of conventional harnesses 22. The logging block 16 used in the present invention operate generally like a free-wheeling pulley having radially extending teeth. By use of the logging blocks 16 and conventional harnesses 22, placed intermittently along the mono-cable system path, the cable 12 is suspended above the ground 24.

Figure 2:
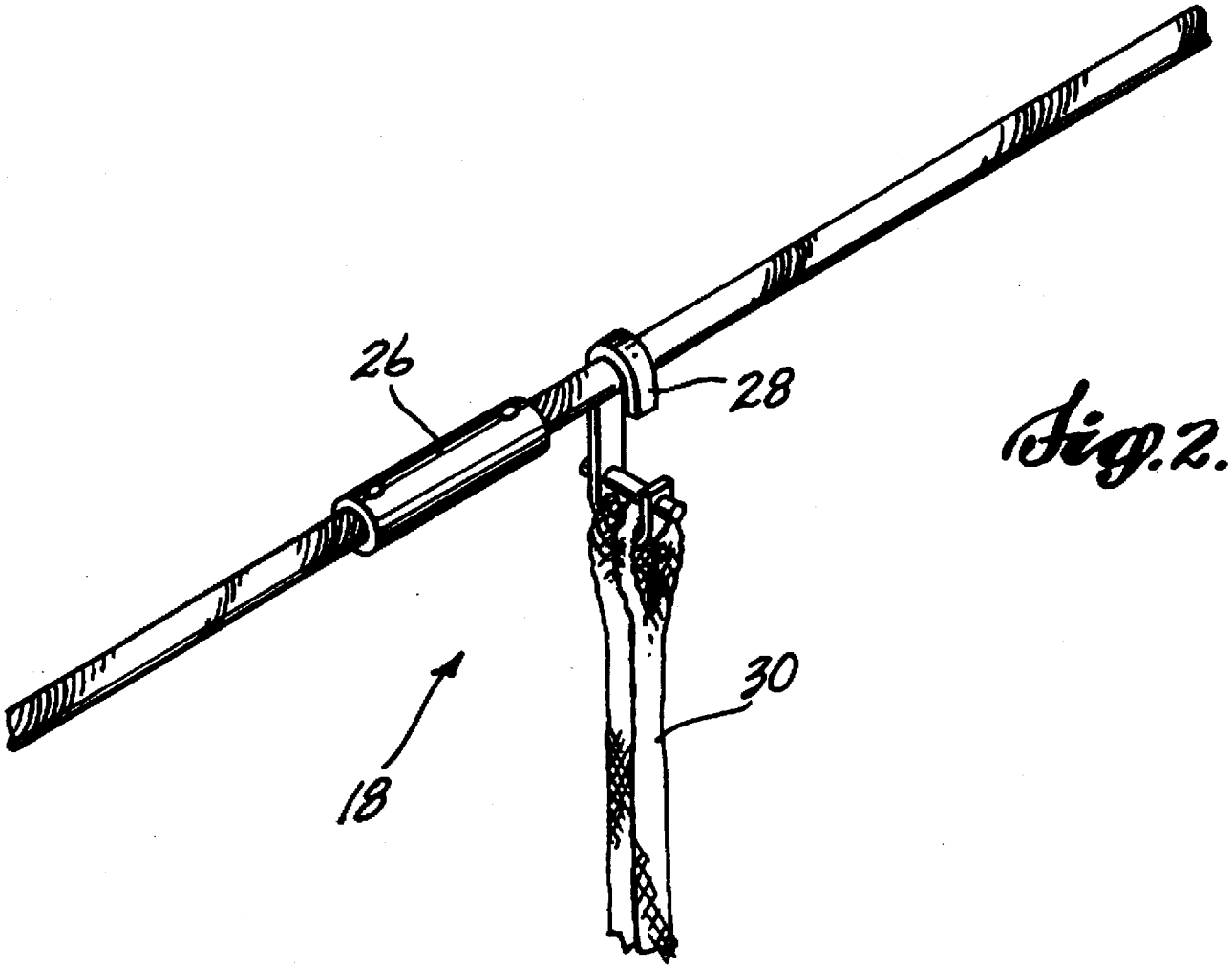
FIG. 2 is a detailed perspective view of a log-securing assembly used to carry out the present invention.

As better understood by reference to FIG. 2 in conjunction with FIG. 1, each log-securing assembly 18 includes a stopper 26, hook 28, and choker 30. A plurality of stoppers 26, which are shown as annular sleeves in the illustrated embodiment, are secured intermittently along the length of the cable 12. The stoppers 26 have conventionally been made from an annular metal sleeve, which due to its inflexibility and the constant movement of the cable frequently causes the cable to wear and break along the placement of the stopper. It should be appreciated that the stoppers 26 can also be made of flexible annular material such as hydraulic hose, held in place along the cable by use .of screws, which reduces the wear and breakage of the cable.

A conventional hook is employed to ride on the cable 12 between each intermittent stopper 14. Each hook serves to slidably attach a choker 30 to the cable 12. In the illustrated embodiment, each hook 28 includes one end having a hooked member with a gap large enough to pass over the mono-cable 12, while the opposite end of the hook includes a means such as a clevis for securing the hook to the line of the choker 30.

It should be understood that the cable 12, the logging block 16, the log-securing assemblies 18, and the harnesses 22, used in conjunction with the present invention, are conventional and are well known to one of ordinary skill in the logging art. It should also be appreciated that the illustrated embodiment of the log-securing assembly is just one configuration which has utility in the present application. Other types of stoppers, hooks, and chokers that include different means for securing a log to the mono-cable system can also be used in accordance with the present invention.

Continuing to refer to FIG. 1, under conventional operation of the mono-cable system, the power system 14 drives the cable 12 along the path of the mono-cable system as indicated by direction arrows 32. The movement of the cable carries the log-securing assembly 18 to a location indicated by arrow 34 along the path of the mono-cable system where fallen logs 36 are located. In a conventional mono-cable system, the fallen logs 36 would then be physically carried from their initial resting place to a point directly adjacent the cable 12, whereupon they would be hoisted such that the choker 30 could be placed around one end of the fallen log 36, and the hook 28 could be placed on the cable 12. After the fallen log or logs 36 are secured to the cable 12 by means of the log-securing assembly 18, the cable 12 is advanced, continuing along the path of the mono-cable system. If the friction between the hook 28 and the cable 12 is not great enough to prevent the cable from moving though the hook, the hook will eventually be engaged by the stopper 26, at which point the hook and associated secured log 38 will be forced to move along the predetermined path 32 of the mono-cable system.

The secured logs 38 are subsequently carried along the path of the mono-cable system to a transport location indicated by arrow 40, where in conventional mono-cable systems the hook 28 of the log-securing assembly 18 is disengaged from the cable 12, leaving the transported logs 42 by a logging road 44 where they can subsequently be loaded onto logging transports (not shown) for removal from the logging area.

Figure 3:
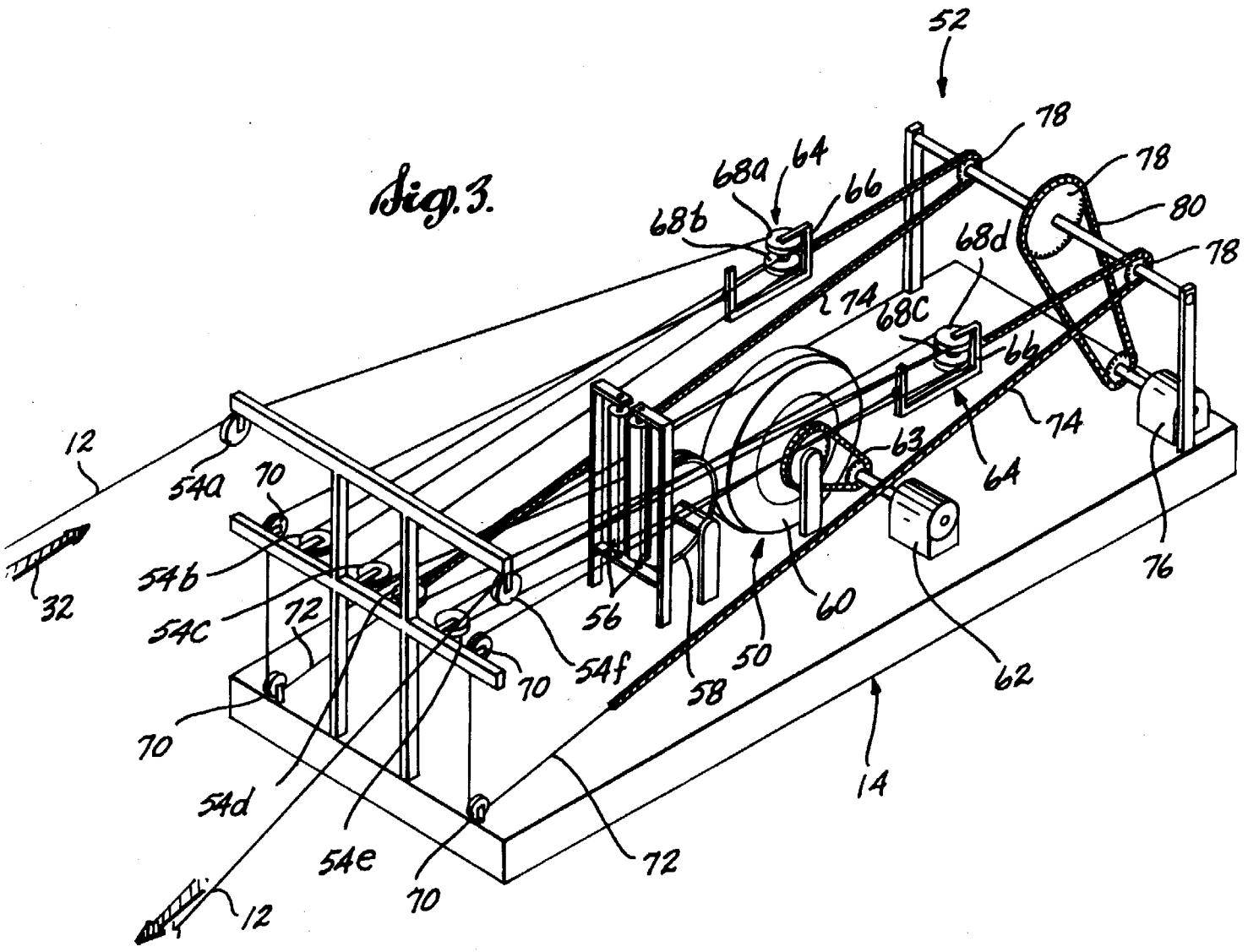
FIG. 3 is a perspective view of the power system of FIG. 1 having a drive system and a tension system used to carry out the present invention, wherein the tension system is fully retracted to provide maximum tension of the cable.
Figure 5:
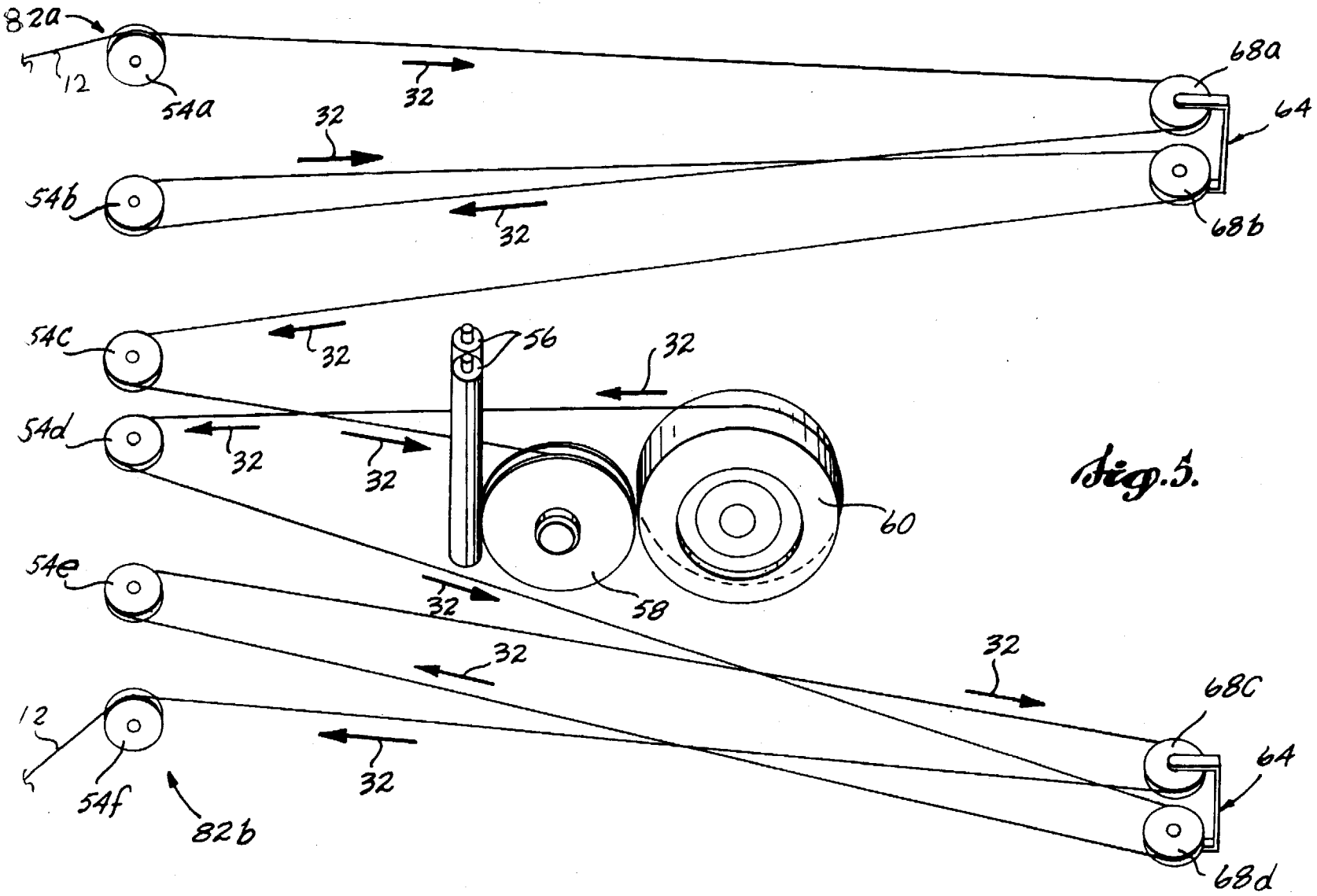
FIG. 5 is an overhead diagram view of elements of the drive system and tension system of the power system of FIG. 3 for use in the present invention.

Referring now to FIGS. 3 and 5, the power system 14 of the mono-cable system 10 includes a drive system 50 and a tension system 52, used to carry out the steps of the present invention. It should be understood by those skilled in the logging art that the illustrated embodiment of the power system 14 of the mono-cable system is just one configuration which has utility in the present invention. Other types of drive systems and tension systems can also be used in accordance with the present invention.

The drive system 50 includes a series of drive pulleys 54, vertical position rollers 56, a guide roller 58, a drive wheel 60, a drive system hydraulic motor 62, and a drive chain 63, with which the drive system motor 62 drives the drive wheel 60. The tension system 52 includes pulley carriages 64 having carriage bars 66 upon which carriage pulley 68 are mounted, tension pulleys 70, tension lines 72, tension chains 74, a tension system hydraulic motor 76, and gears 78, and a drive chain 80, with which the tension system motor drives the tension system 52 by way of the gears 78.

The cable 12 of the mono-cable system passes through both the drive system 50 and tension system 52 as it is advanced in the direction indicated by arrow 32. The cable 12 enters the power system 14 at the location indicated by arrow **82*a* and passes through drive pulley 54*a*, carriage pulley 68*a*, drive pulley 54*b*, back through carriage pulley 68*b*, and then through drive pulley 54*c*. Cable 12 then continues through vertical position rollers 56 and along the guide roller 58 before engaging the drive wheel 60. The cable 12 then repeats its path through mirror image pulleys opposing those previously described. Specifically, the cable passes over the drive wheel 60, through the vertical position rollers 56, drive pulley 54*d*, carriage pulley 68*c*, drive pulley 54*e*, and back through carriage pulley 68*d*, before passing out of the power system 14 via drive pulley 54*f*. With the cable so intertwined between the pulleys of both the drive system and the tension system, the drive system motor 62 engages the drive wheel 60 in advancing the cable 12 along the path shown by direction arrow 32. While the illustrated embodiment shows cable movement in one direction, it should be understood that the drive system 50** can be used in the mono-cable system of the present invention wherein the cable moves in either direction.

Figure 4:
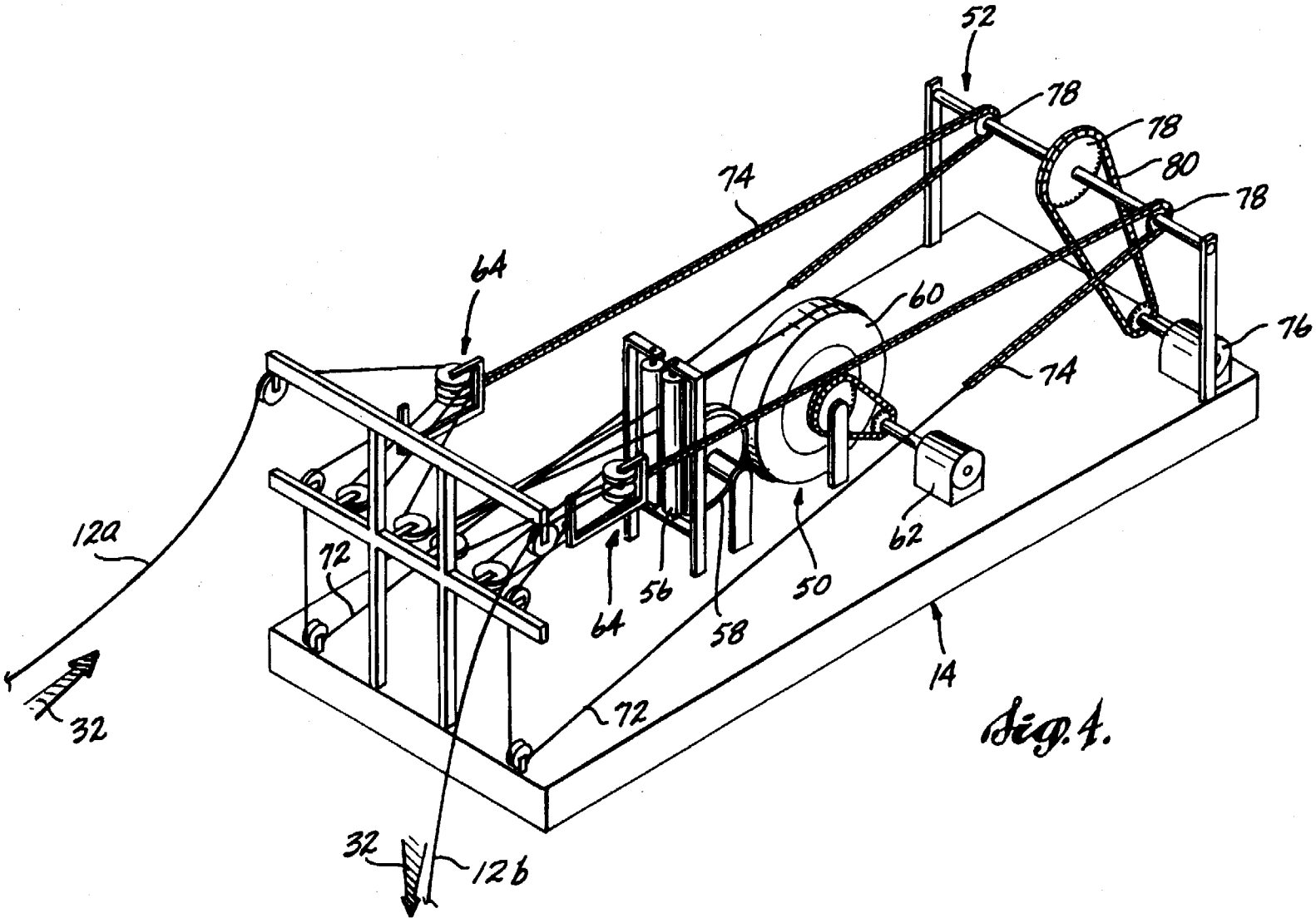
FIG. 4 is a perspective view of the power system of FIG. 3, wherein the tension system is fully extended to provide maximum slack in the cable.

As better understood by reference to FIGS. 3–5, the tension system 52 is used in conjunction with the drive system 50 in the present invention to produce slack in the cable 12. With initial reference to FIG. 3, the tension system 52 is illustrated in its retracted mode, or that position in which the cable 12 is most taut throughout the mono-cable system. When so requested by a worker along the mono-cable system 10, the tension system motor 76 is remotely engaged using a remote system (not shown) well known in the relevant field to rotate the gear 78 of the tension system via the drive chain 80. These gears in turn engage the tension chains 74, attached to one end of the carriage bars 66, and at their other end to the tension lines 72, which in turn are connected to the ends of the carriage bars 66 opposing those ends connected to the tension chains 74. The tension lines 72 pass through tension pulleys 70, completing a circuit wherein the tension lines 72 and the tension chains 74 in combination produce a loop for moving the carriage bars of the tension system along the length of the power system 14. The tension lines 72 and tension chains 74 are sufficiently taut so as to suspend the carriage bars of the tension system within the power system, and in line with the cable 12 of the drive system 50.

As the tension system motor 76 drives the tension system gears 78, the tension chains 74 advance pulley carriages 64, with the corresponding carriage pulleys 68, causing the tension system 52 to extend the length of the power system 14. As more clearly understood by reference to FIG. 4, in the fully-extended position, the pulley carriages 64 of the tension system 52 create slack in the cable 12, both to the incoming cable designated **12*a* as well as the outgoing or return cable designated 12*b***.

With the function of both the drive system 50 and the tension system 52 fully explained, the operation of the mono-cable system as used in the present invention is described below.

Figure 6:
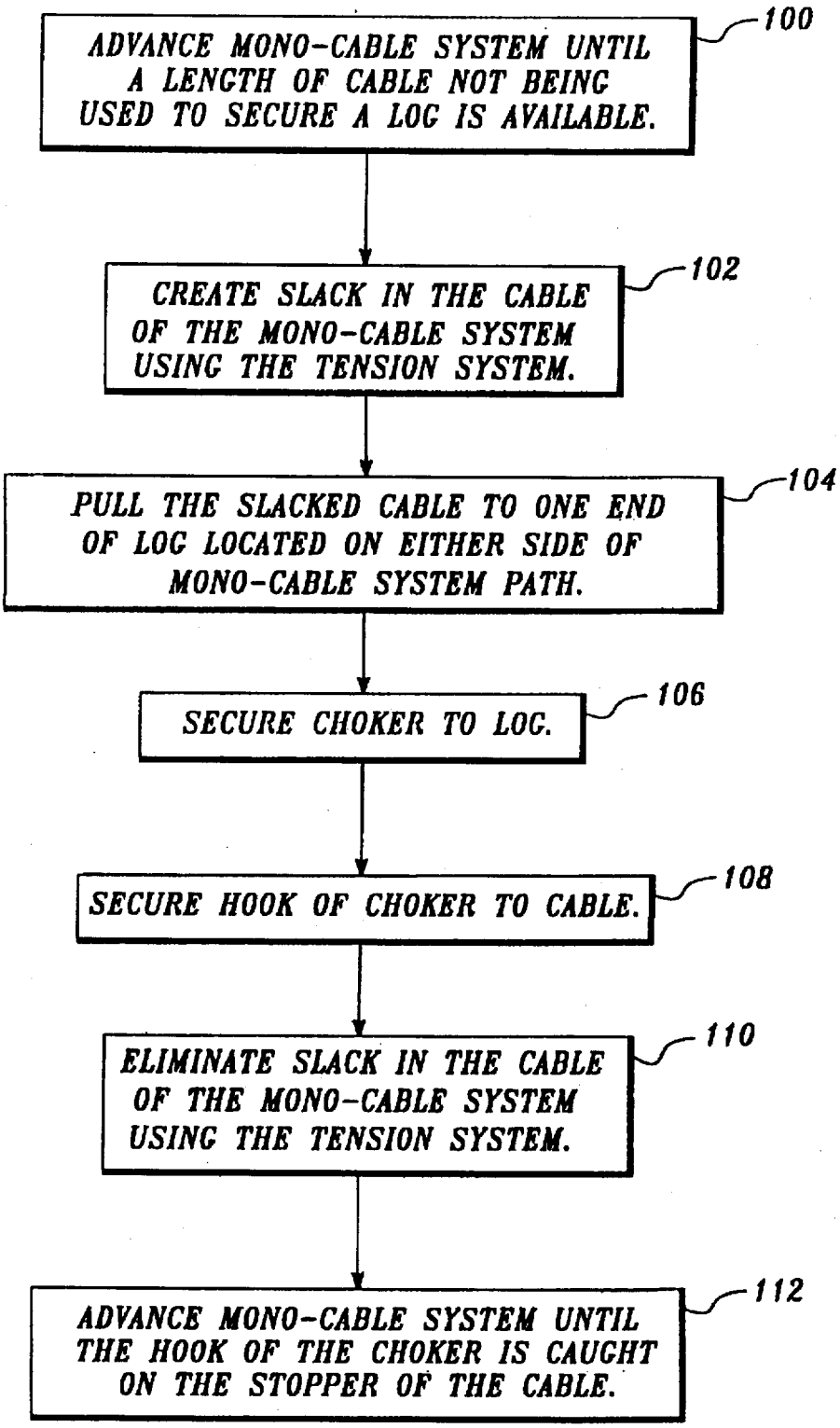
FIG. 6 is a flowchart illustrating the steps carried out in the present invention for introducing slack into a mono-cable system so as to transport the cable to a log.
Figure 7:
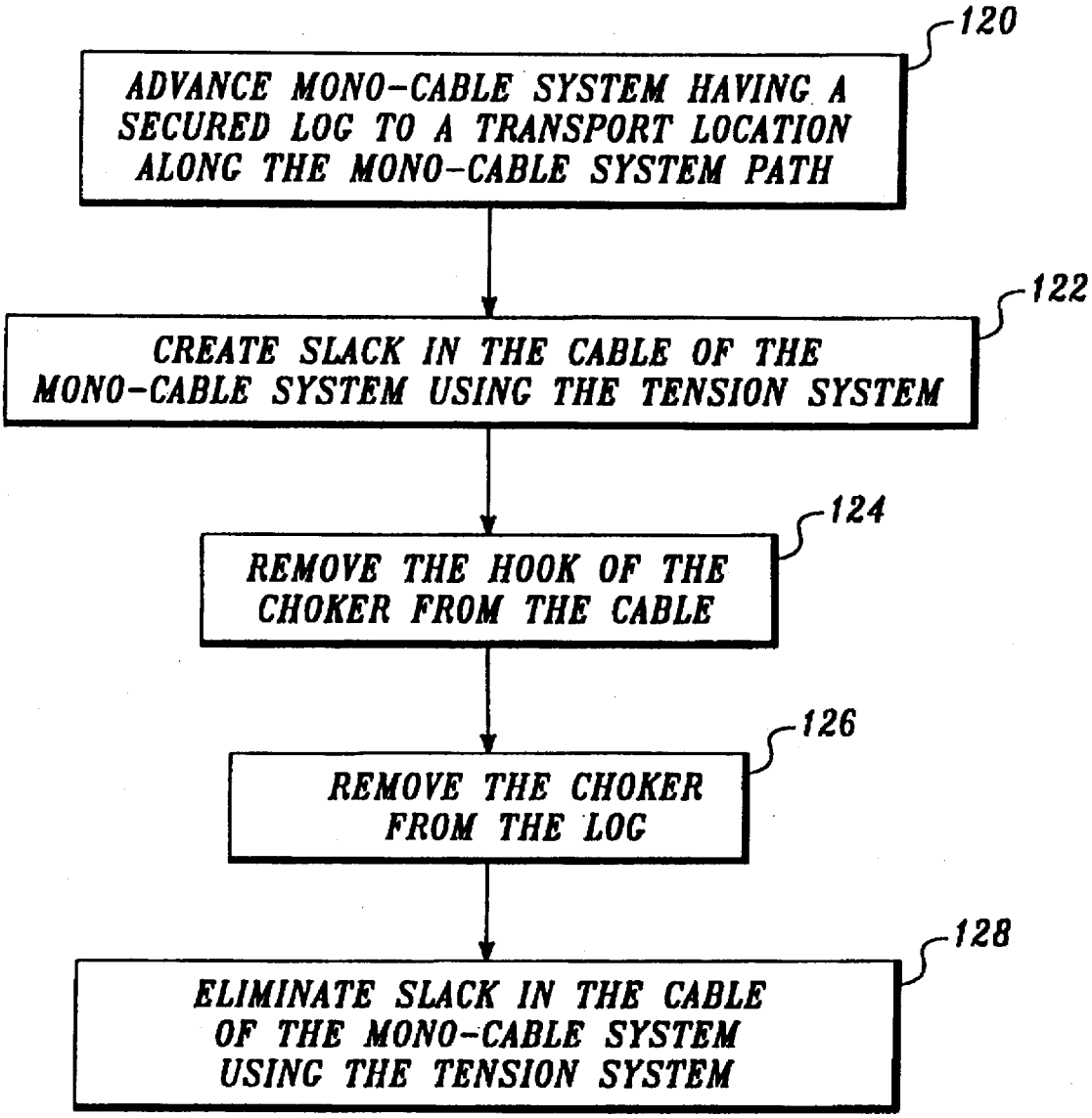
FIG. 7 is a flowchart illustrating the steps carried out by the present invention for introducing slack in the mono-cable system so as to remove the log from the cable.

The operation of the present invention can best be understood by reference to the flowcharts of FIGS. 6 and 7 in conjunction with the environmental view of the mono-cable system illustrated in FIG. 1. Referring to FIG. 6, the logic of the present invention begins at block 100, wherein the cable 12 is advanced by the drive system 50 located in the power system 14 until a length of cable not being used to secure a log is available near a felled tree or log to be yarded is located. Referring now to FIG. 1, the cable 12 would be advanced according to the direction arrows 32 to the location indicated by arrow 34 and located near fallen log 36*a*, at which point the drive system 50 would be disengaged, and the motion of the cable 12 would be stopped. At block 102, the tension system 52 would be engaged, and the pulley carriages 64 of the tension system would be extended from their retracted position as shown in FIG. 3 to their extended position as shown in FIG. 4, causing slack 90*a* in the cable. As shown in FIG. 1, the slack 90*a* would allow the cable 12, and the associated log-securing assembly 18, to be pulled freely to one end of the fallen log 36, as described at block 104. At block 106, the choker 30 is secured to one end of the fallen log 36, and at block 108, the hook 28 of the choker 30 is secured to the cable 12.

At block 110, the tension system 52 is again engaged, causing the pulley carriages 64 to retract from their extended position shown in FIG. 4 to their retracted position shown in FIG. 3, causing the slack 90*a* to be taken out of the cable 12. This in turn causes the fallen log 36 to be retrieved from its position on one side of the mono system path to a position directly adjacent the mono-cable system path. At block 112, the drive system 50 is again engaged, and the mono-cable system 10 is advanced until the hook 28 of the choker 30 is caught on the next stopper 26 along the cable 12, or until sufficient friction exists between the hook and the moving cable to carry the weight of the secured log or logs 38 forward along the mono-cable system path. The steps of the present invention described in boxes 100–112 above are repeated for each fallen log or logs to be secured in the logging area.

With particular reference to FIG. 7 in conjunction with FIG. 1, the drive system 50 advances the mono-cable system having a secured log 38 to the transport location 44 located along the mono-cable system path, as described at block 120. The drive system 50 is then disengaged, stopping further advancement of the mono-cable system. At block 122, the tension system 52 is engaged, causing the pulley carriages 64 to extend from their retracted position as shown in FIG. 3 to their extended position shown in FIG. 4, thereby creating slack 90*b* in the cable 12. At block 124, the hook 28 of the choker 30 is removed from the cable 12, and at block 126, the choker 30 is removed from the secured log 38, thereby positioning the log at the transport location 44 for subsequent loading onto vehicles for transport from the logging area. At block 128, the tension system 52 is again engaged, causing the pulley carriages 64 to retract from their extended position shown in FIG. 3 to their retracted position shown in FIG. 4, eliminating the slack 90*b* in the cable of the mono-cable system. The steps of the present invention described in boxes 120–128 are repeated for each secured log or logs to be removed from its secured position along the cable of the mono-cable system.

While the operation of the present invention has been described with reference to securing or choking only a single end of a fallen log, it should be understood that the present invention is equally applicable to situations in which both ends of a fallen log are to be secured for retrieval by the mono-cable system. Yet another advantage of the present invention over conventional mono-cable systems is its ability to produce slack in the cable, not only to facilitate retrieval of a fallen log from its felled position to the path of the mono-cable system, but also to secure the second end of the fallen log such that the secured log can be advanced along the mono-cable system path completely suspended above the ground.

It should be understood that while the particular embodiment of the present invention has been illustrated using a specific mono-cable system, other mono-cable systems configured in various ways can also be used in accordance with the present invention. While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of yarding logs for use with a mono-cable system having a continuous loop of cable strung through a logging area along a path that the logs are to be conveyed, a drive system for advancing the continuous loop of the cable along the path, a tension system for creating slack in the cable, and choking equipment including chokers, hooks connected to one end of each choker, and stoppers along the length of the cable at intermittent locations, used to secure felled trees or logs to the cable, the method comprising:

(a) advancing the cable using the drive system along the path until a length of cable not being used to secure a log is available;

(b) creating slack in the cable using the tension system;

(c) transporting the cable having slack to a log;

(d) securing the choker to the log;

(e) securing the hook of the choker to the cable;

(f) eliminating slack in the cable using the tension system such that the secured log is retrieved from its position; and (g) advancing the cable using the drive system until the hook of the choker is caught on the stopper of the cable.

2. The method of claim 1, further comprising:

(a) advancing the cable having the secured log using the drive system to a transport location along the path;

(b) creating slack in the cable using the tension system;

(b) removing the hook of the choker from the cable;

(c) removing the choker from the log; and (d) eliminating slack in the cable using the tension system.

3. The method of claim 1, wherein the log is located on either side of the path of the mono-cable system.

4. A method of yarding logs for use with a mono-cable system having a continuous loop of cable strung through a logging area along a path that the logs are to be conveyed, a drive system for advancing the continuous loop of the cable along the path, a tension system for creating slack in the cable, and choking equipment including chokers, hooks connected to one end of each choker, and stoppers along the length of the cable at intermittent locations, used to secure felled trees or logs to the cable, the method comprising:

(a) advancing the cable having the secured log using the drive system to a transport location along the path;

(b) at the transport location, creating slack in the cable using the tension system;

(c) after creating slack in the cable, removing the hook of the choker from the cable;

(d) removing the choker from the log; and (e) after removing the hook of the choker, eliminating slack in the cable using the tension system.

5. A mono-cable system for yarding logs comprising:

(a) a continuous loop of cable strung through a logging area along a path that the logs are to be conveyed;

(b) choking equipment used to secure the logs to the cable;

(c) a base unit; and (d) a power system mounted to the base unit for advancing the continuous loop of the cable along the path and producing slack in the cable, said power system having a drive system for advancing the cable along the path that the logs are to be conveyed and a tension system used in conjunction with the drive system to produce slack in the cable, wherein the tension system comprises:

(i) a pulley carriage assembly movably mounted to the base unit; and (ii) a tension system motor assembly mounted to the base unit and connected to the pulley carriage assembly for advancing and retracting the pulley carriage assembly to create and eliminate tension in the tension system.

6. The system of claim 5, wherein the pulley carriage assembly comprises:

(a) at least one pulley carriage;

(b) at least one tension pulley mounted to the base unit; and (c) at least one continuous loop tension linkage linking the tension system motor assembly to the at least one pulley carriage and at least one tension pulley such that as the tension system motor assembly advances and retracts the suspended pulley carriage produces and eliminates tension in the tension system.

7. The system of claim 5, wherein the tension system motor assembly comprises:

(a) a tension system motor securely mounted to the base unit having a rotatable drive shaft;

(b) a rotatable tension shaft having a gear; and (c) a continuous loop drive chain linking the drive shall of the tension system motor to the gear of the rotatable tension shaft for rotatably driving the rotatable tension shaft.

* * * * *

UNITED STATES PATENT AND TRADEMARK OFFICE

CERTIFICATE OF CORRECTION

PATENT NO. : 5,673,625
DATED : October 7, 1997
INVENTOR(S) : G.E. Dahlstrom

It is certified that error appears in the above-identified patent and that said Letters Patent is hereby corrected as shown below:

| COLUMN | LINE | |
|---|---|---|
| Title page, item [54] & Col. 1, line 1 | Title | After "METHOD" delete "OF" and insert --AND APPARATUS FOR-- |
| 10 (Claim 2, | 44 line 5) | "(b) removing the hook" should read --(c) removing the hook-- |
| 10 (Claim 2, | 45 line 6) | "(c) removing the choker" should read --(d) removing the choker-- |
| 10 (Claim 2, | 46 line 7) | "(d) eliminating" should read --(e) eliminating-- |
| 12 (Claim 7, | 19 line 6) | "shall" should read --shaft-- |

Signed and Sealed this

Third Day of March, 1998

*Attest:*

Bruce Lehman

BRUCE LEHMAN

*Attesting Officer*

*Commissioner of Patents and Trademarks*